US007681483B1

(12) United States Patent
Rhoades et al.

(10) Patent No.: US 7,681,483 B1
(45) Date of Patent: Mar. 23, 2010

(54) SUB-CALIBER IN-BORE WEAPONS TRAINING APPARATUS

(75) Inventors: William R. Rhoades, Columbus, OH (US); Patrick W. Jordan, Ekron, KY (US)

(73) Assignee: American Apex Corporation, Dublin, OH (US)

( * ) Notice: Subject to any disclaimer, the term of this patent is extended or adjusted under 35 U.S.C. 154(b) by 895 days.

(21) Appl. No.: 11/122,142

(22) Filed: May 4, 2005

(51) Int. Cl.
*F41A 21/10* (2006.01)

(52) U.S. Cl. ..... 89/29; 89/135

(58) Field of Classification Search ..... 89/29, 89/135, 136, 129.01, 130; 42/77
See application file for complete search history.

(56) References Cited

U.S. PATENT DOCUMENTS

| | | | | |
|---|---|---|---|---|
| 2,269,297 | A * | 1/1942 | White | 89/42.01 |
| 2,380,455 | A * | 7/1945 | Lippert et al. | 89/135 |
| 2,423,446 | A * | 7/1947 | Grant, Jr. | 89/1.4 |
| 3,088,225 | A | 5/1963 | Amistadi | |
| 3,112,671 | A | 12/1963 | Dunham et al. | |
| 3,339,304 | A | 9/1967 | Knode, Jr. et al. | |
| 3,771,415 | A | 11/1973 | Into et al. | |
| 4,362,145 | A | 12/1982 | Stelcher | |
| 4,427,386 | A | 1/1984 | Fields | |
| 4,439,156 | A | 3/1984 | Marshall et al. | |
| 4,496,159 | A * | 1/1985 | Dugan et al. | 273/361 |
| 4,605,372 | A * | 8/1986 | Nyzell | 434/16 |
| 4,983,123 | A | 1/1991 | Scott et al. | |
| 5,415,074 | A * | 5/1995 | Fields | 89/29 |
| 5,485,788 | A * | 1/1996 | Corney | 102/472 |
| 6,050,170 | A | 4/2000 | Guiette, III et al. | |
| 6,314,671 | B1 * | 11/2001 | Gering | 42/70.11 |
| 6,412,207 | B1 * | 7/2002 | Crye et al. | 42/70.06 |
| 6,626,113 | B1 | 9/2003 | Gilman et al. | |
| 6,732,464 | B2 * | 5/2004 | Kurvinen | 42/69.01 |
| 2003/0056639 | A1 * | 3/2003 | Giza | 89/1.701 |

* cited by examiner

*Primary Examiner*—Stephen M Johnson
(74) *Attorney, Agent, or Firm*—Standley Law Group LLP

(57) ABSTRACT

A sub-caliber in-bore device placed within a launching structure of a larger caliber weapon system used to simulate the firing and ballistic trajectory of a larger and relatively more expensive weapons round. The said device essentially comprises a smaller caliber weapon subsystem with recoil suppression mounting subsystem, traverse and elevation adjustment subsystem, firing circuit delay timer, and an electrical connection subassembly to allow communications with the launching system. This invention provides an accurate, realistic, and cost-effective training experience to the operator.

18 Claims, 7 Drawing Sheets

SUB-CALIBER IN-BORE WEAPONS TRAINING APPARATUS

FIELD OF THE INVENTION

The present invention described herein relates to the field of military ordnance. In particular, it relates to a weapons training system which uses an in-bore sub-caliber weapon and firing delay timer scheme to provide realistic and cost-effective operator training.

BACKGROUND AND SUMMARY OF THE INVENTION

Military armament systems continue to become increasingly complex and technologically sophisticated. With this increase in complexity and sophistication comes an increase in cost. For example, a weapon currently in the arsenal of the U.S. Army is the TOW (Tube-launched, Optically-tracked, Wire-guided) missile system. This anti-tank weapon system fires a sophisticated missile that is launched from a launching tube, optically-tracked over a period of up to, for example, approximately 20-seconds, and controlled in-flight to the target by an operator via a deployed wire communications umbilical that allows communication between the operator and the in-flight missile. Once the weapon is fired, the only action required by the operator is to keep the optical sight cross-hairs on the target until weapon impact. To effectively employ this weapon, the operator needs to be trained to maintain the target within the sights of the weapons target tracking system until target impact by the weapon. The cost to launch a TOW missile can be expensive which prohibits a large number of these systems to be consumed during training exercises. In an effort to minimize the cost of training personnel in the operation of expensive military armament systems, it has been a common practice to place a smaller caliber weapon system, which fires less expensive ammunition, in the bore of the larger launching system. When fired, the smaller caliber projectile simulates the firing and ballistic trajectory of an actual and more expensive round providing an accurate, realistic, and cost-effective training experience to the operator. The use of smaller caliber ammunition reduces cost and allows training to be conducted on readily available and less expensive small arms ranges. However, these methods heretofore do not account for the time-of-flight (TOF) of the simulated weapon and consequently do not provide the needed optical tracking time necessary for operator training. Attempts to simulate weapon systems operation using computer-based virtual video displays have been made, but these systems suffer from the lack of their ability to provide the operator with a realistic hands-on training experience under actual field conditions. Consequently, there is a need to devise cost-effective ways of providing weapons operators realistic training on such weapons systems.

This invention provides an exemplary embodiment of an in-bore sub-caliber training apparatus for use in a TOW weapon system having the capability to interface with a TOW launching system and simulate the TOF and resultant target impact point of a more expensive TOW missile.

This invention further provides an exemplary embodiment of an in-bore sub-caliber training apparatus for use in a projectile launching weapon system having the capability to interface with and simulate the characteristics of a more expensive, larger caliber system.

This invention still further provides an exemplary embodiment of an in-bore sub-caliber training apparatus capable of firing ammunition of different calibers.

The said training apparatus essentially comprises a sub-caliber weapon that is supported in-bore of the launching tube of a TOW missile. The said sub-caliber weapon employs recoil suppression and is supported via forward and rear mounting brackets designed to fit within and attach to an existing launching tube. The said rear mounting bracket comprises an adjustment mechanism to allow precise aiming refinement in both traverse and elevation of the sub-caliber weapon to ensure the ballistic trajectory and resulting impact point of the fired sub-caliber round coincides with the aim-point as seen by the operator. A ballistic timer, actuated upon firing, delays firing of the sub-caliber weapon for a time interval equal to that calculated for the TOF of the larger simulated weapon. This firing delay allows the operator to gain training experience by optically tracking a target for the time the simulated weapon would otherwise be in-flight. At the end of the delay period and approximately at the calculated time of impact of the simulated weapon, the sub-caliber weapon is allowed to fire a projectile at the target location last sighted by the operator. The impact point of the sub-caliber projectile provides the operator instant feedback on his/her targeting accuracy.

In one aspect of the invention, the sub-caliber device may be used in systems other than TOW type designs.

In yet another aspect of the invention, the sub-caliber weapon may be interchanged with weapons of other calibers.

This invention offers superior training by providing the operator realistic TOF tracking time of the simulated weapon and allowing the operator to fire multiple times at a significant cost savings as opposed to firing relatively fewer actual and relatively more expensive weapons.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF THE EXEMPLARY EMBODIMENT(S)

Figure 1:
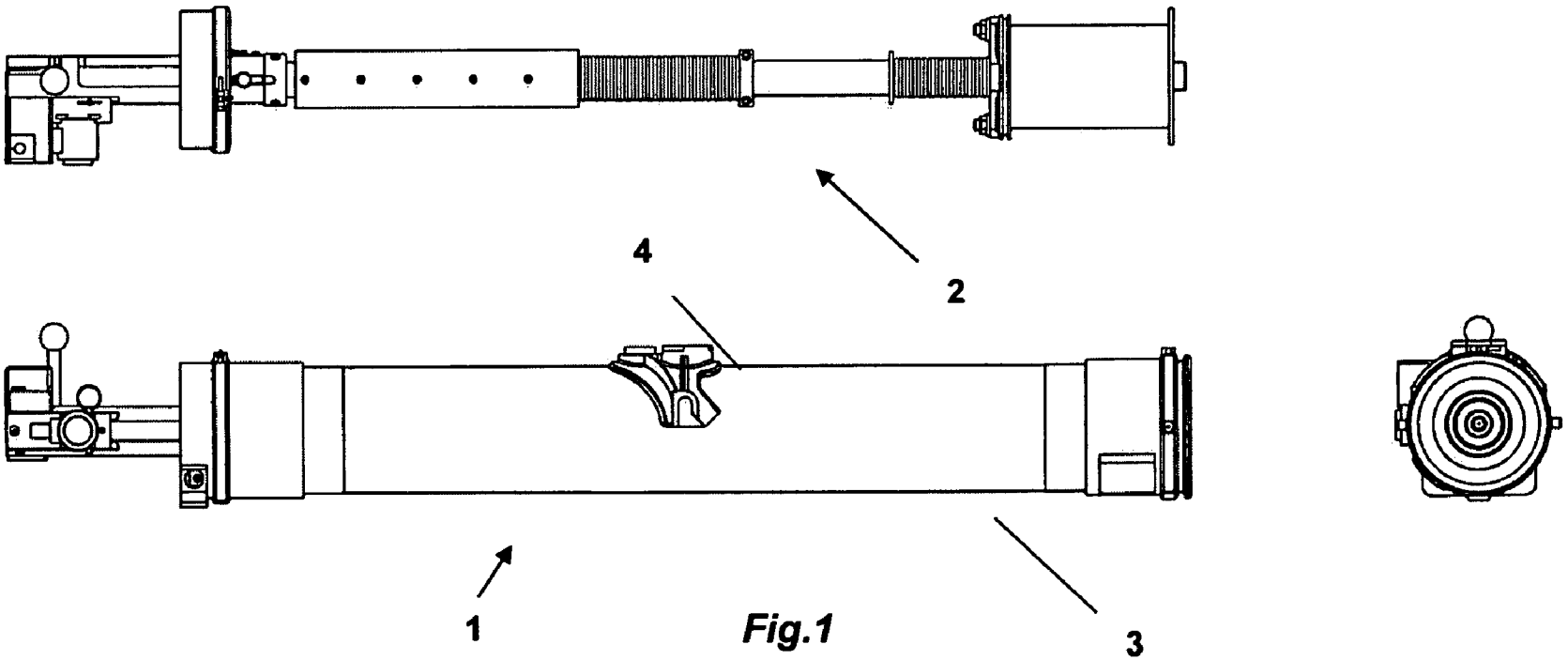
FIG. 1 is an orthogonally projected view of an exemplary embodiment of the invention with the top projection showing the invention with the external launching tube removed.

Referring now to FIG. 1, the invention top-level assembly 1 comprises a sub-caliber weapon system 2 encapsulated within a launching tube 3. An electrical connector 4, mounted on the exterior of the launching tube 3 allows the apparatus to communicate with an extant weapons launching system. The launching tube 3 may be a new item or one that has been refurbished after previous use.

Figure 2:
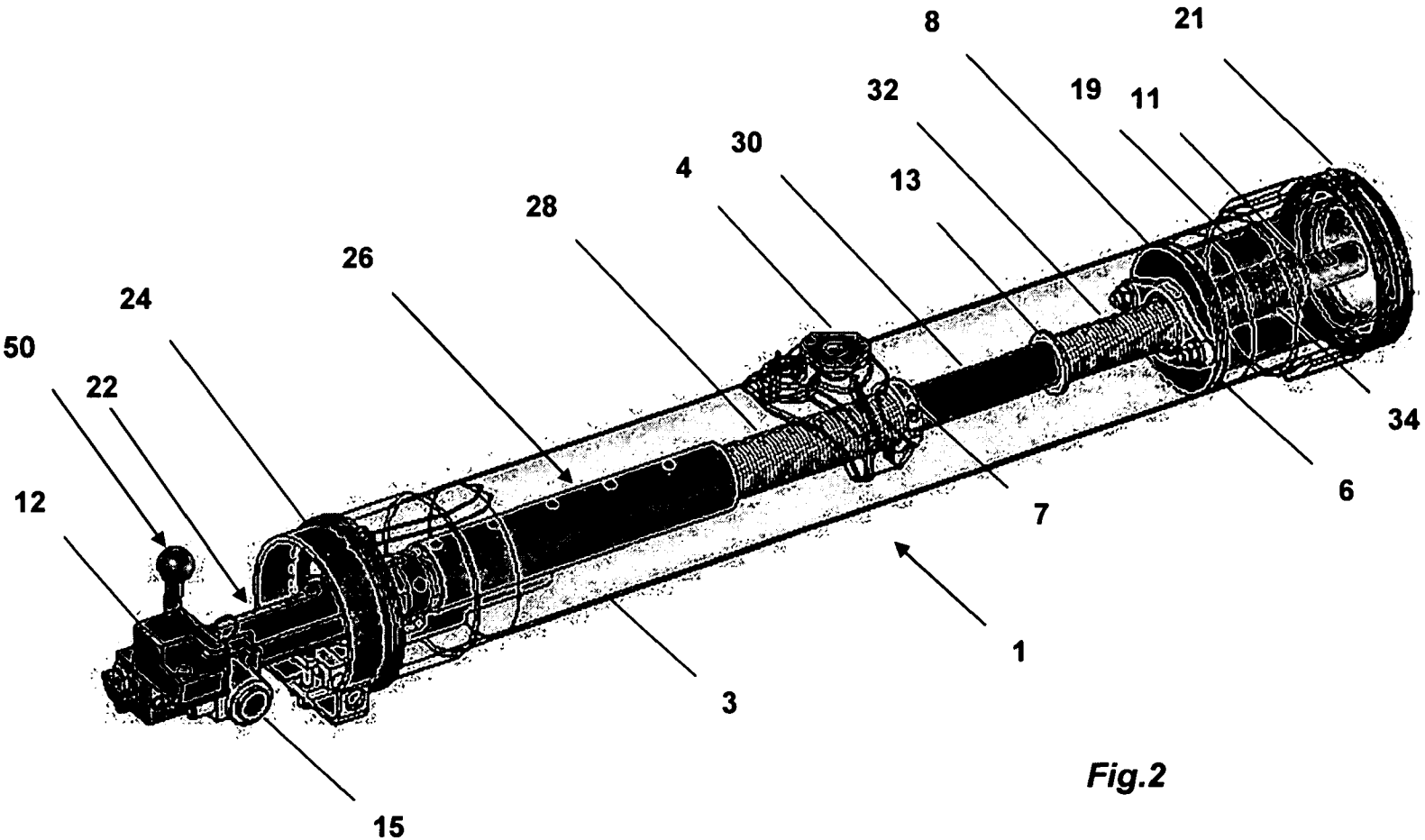
FIG. 2 is a rear isometric projection of an exemplary embodiment of the invention with the external launching tube depicted semi-transparently illustrating the sub-caliber weapon and mounting subsystems.

FIG. 2 shows the essential components of the invention 1, with the launching tube 3 semi-transparently illustrated. A sub-caliber gun barrel 30 is suspended approximately concentric to and in-bore within the launching tube 3 by means of a front end adaptor 8 and rear support adaptor 24 with the front end adaptor 8 comprising a groove to retain an o-ring 6 which promotes a removably fixed interface with the interior surface of the launching tube 3. A connecting tube 19 retains the front end adaptor 8 longitudinally within the launching tube 3 by means of a locking ring 21. Recoil forces developed on the barrel 30 during firing of the sub-caliber weapon is mitigated by springs 28, 32, and 34 which are retained on barrel 30 by means of locking rings 7, 13, and 11 respectively. A traverse and elevation guide tube subassembly 26 supports the breech-end of barrel 30 and permits longitudinal movement of the barrel 30 caused by recoil forces. The receiver subassembly 22 is removably attached to the breech-end of barrel 30 and is used to receive and guide selected sub-caliber ammunition to and from the breech of barrel 30. The bolt and firing-pin subassembly 50 is used to translate and position sub-caliber ammunition from the receiver subassembly 22 into the breech of the barrel 30. The Range-to-Target-Simulator-Selector (RTSS) 12 comprises an electrical timer which is used to selectively choose and incur desired firing delays commensurate with the TOF of the simulated weapon. An operator-initiated electrical firing signal fires the sub-caliber weapon by means of an electro-mechanical firing solenoid 15.

Figure 3:
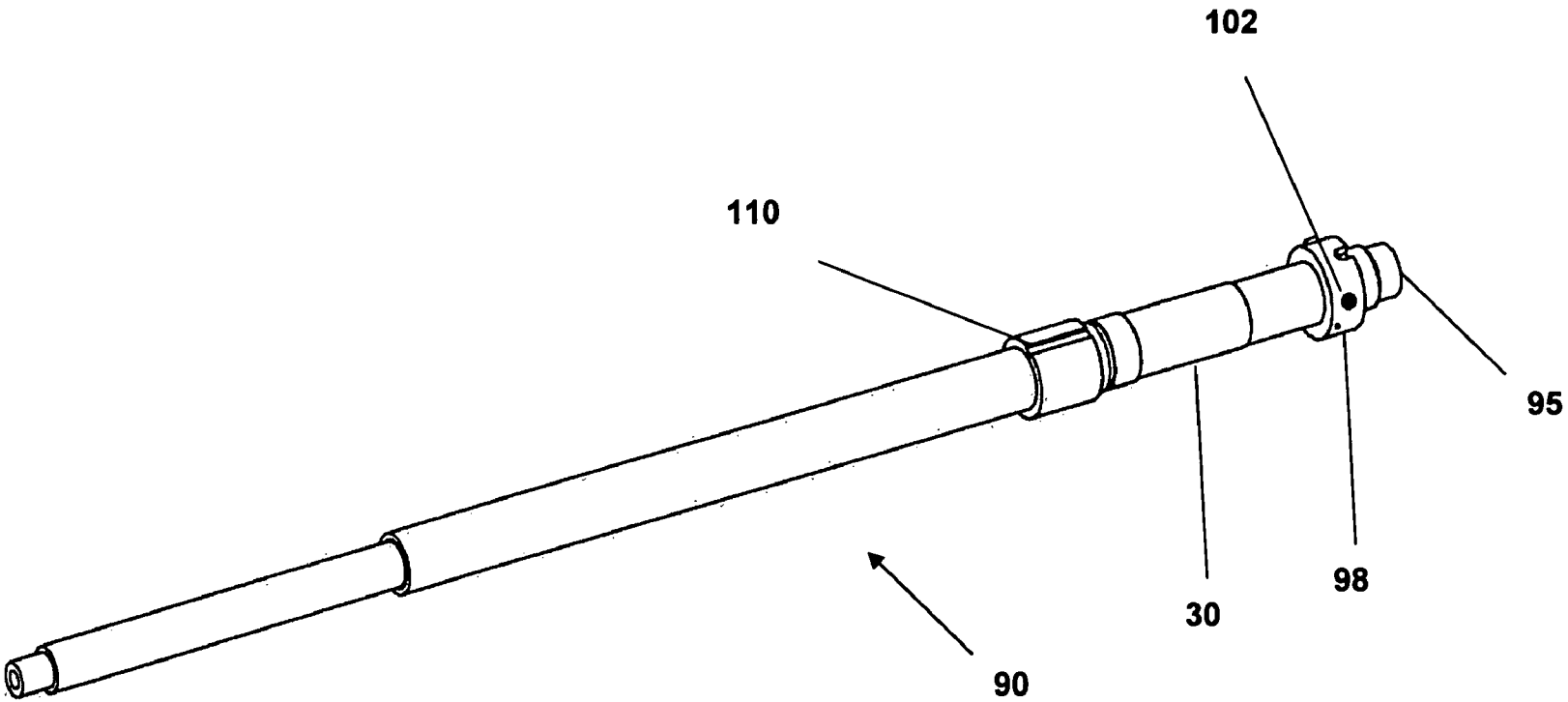
FIG. 3 is a frontal isometric projection of an exemplary embodiment of the sub-caliber gun barrel subassembly.

FIG. 3 shows the barrel sub-assembly 90 of the sub-caliber weapon. In a preferred embodiment, the barrel 30 comprises a .50 caliber bore. A barrel lock ring 98 and barrel lock ring retaining screw 102 prevents inadvertent rotation between the barrel 30 and receiver subassembly 22. The barrel breech 95 comprises a longitudinally concentric cavity within the barrel 30 that accepts and contains a round of selected ammunition during firing.

Figure 4:
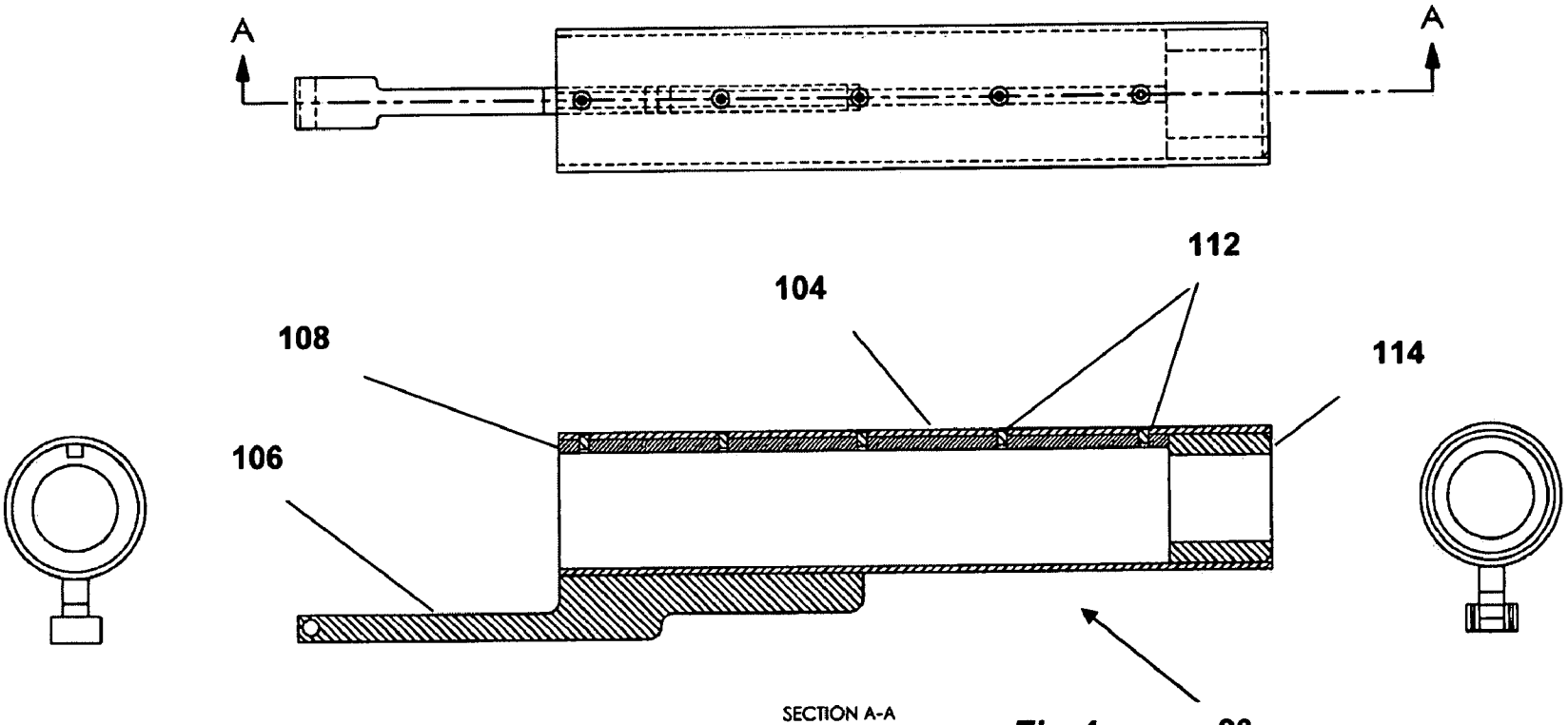
FIG. 4 is an orthogonally projected and sectional view of an exemplary embodiment of the traverse and elevation guide tube subassembly.

Referring now to FIG. 4, the traverse and elevation guide tube subassembly 26 is used to support the breech end of the barrel 30 and is essentially comprised of a traverse and elevation guide tube 104, traverse and elevation adjustment plate 106, anti-roll guide plate 108, and rear slide block 114. The anti-roll guide plate 108 is removably fixed to the traverse and elevation guide tube 104 by means of a plurality of fasteners 112. As shown in FIG. 3, a guide groove 110 embodied on the barrel 30 slidably engages the anti-roll guide plate 108 allowing longitudinal motion of the barrel 30 in response to recoil while preventing rotation of the barrel subassembly 90 within the traverse and elevation guide tube subassembly 26. The traverse and elevation adjustment plate 106 supports the guide tube 104 and is used to position the traverse and elevation guide tube subassembly 26 within the rear support adaptor 24 as will be shown in FIG. 5.

Figure 5:
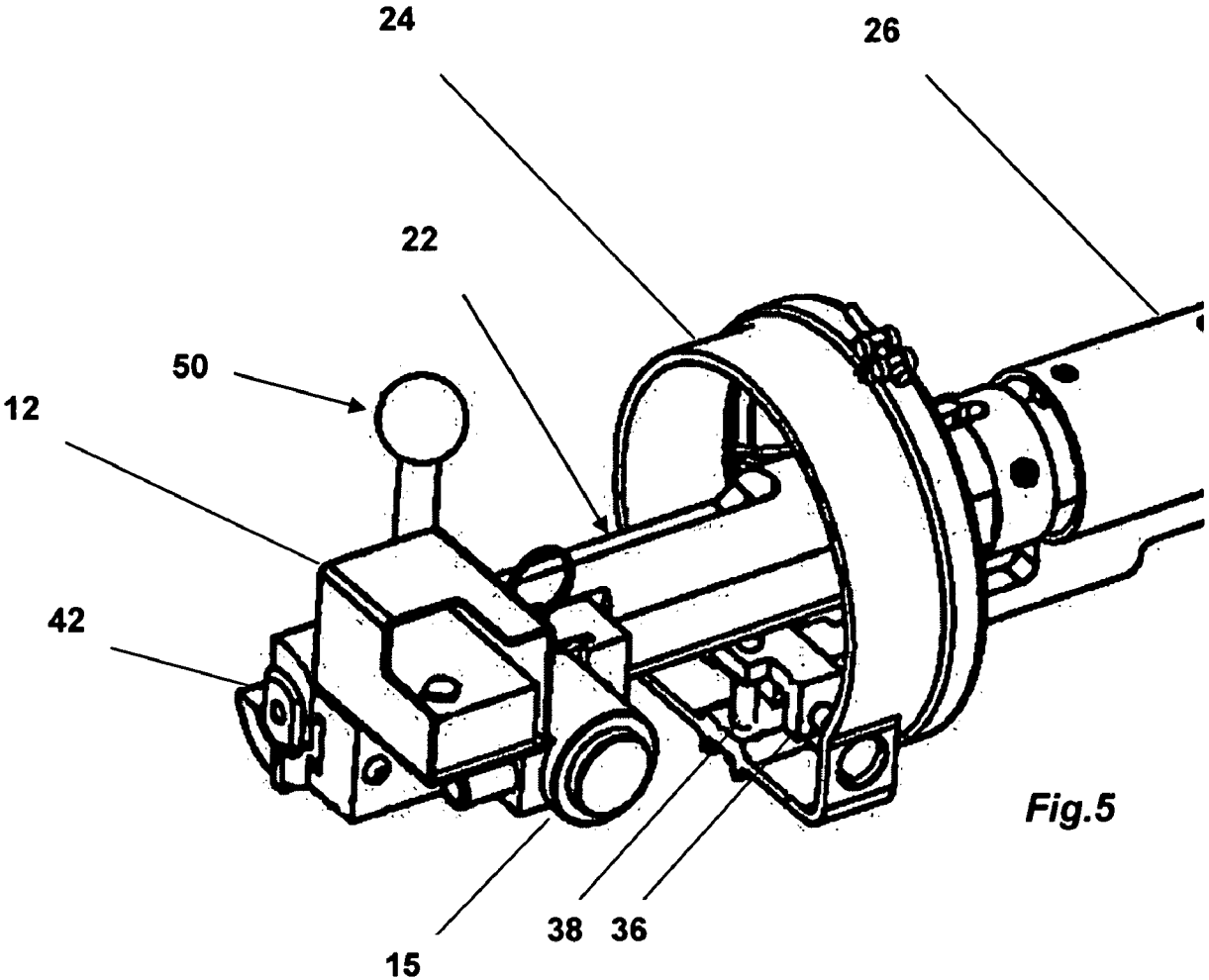
FIG. 5 is a partial rear perspective detail of an exemplary embodiment the bolt, receiver, firing solenoid, ballistic timer, traverse and elevation adjustment mechanism, rear support adaptor, and traverse and elevation guide tube subassemblies.

FIG. 5 shows a detail of the traverse 36 and elevation 38 adjustment screws used to precisely aim the sub-caliber weapon bore-sight within the launching tube 3 to produce the desired relative trajectory of the sub-caliber projectile impact point to that of the simulated larger caliber weapon. Adjustment of the traverse 36 and elevation 38 adjustment screws translate the traverse and elevation guide tube subassembly 26 horizontally and vertically respectively via the traverse and elevation adjustment plate 106. It should be noted that the front end adaptor 8 accommodates off-axis movement of the barrel 30 relative to the longitudinal axis of the launching tube 3 as imparted by adjustments to adjustment screws 36 and 38. It should be further noted that the functions of the traverse 36 and elevation 38 screws may be equivalently realized through, but not limited to, the use of electromechanical servo actuators or other actuation methods known to those skilled in the art.

Figure 6:
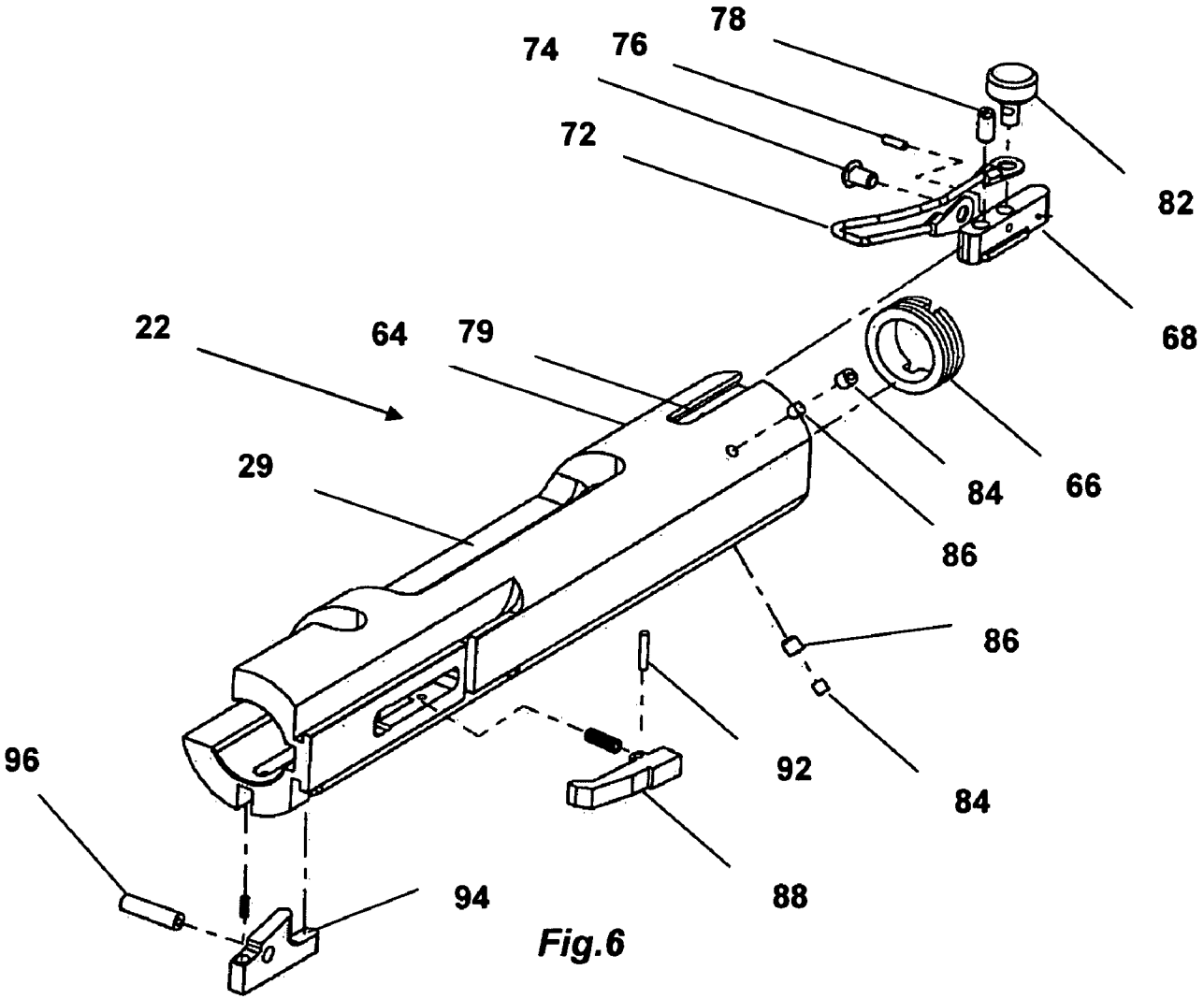
FIG. 6 is a rear isometric exploded projection of an exemplary embodiment of the receiver subassembly.

Referring now to FIG. 6, the receiver subassembly 22 accepts and ejects ammunition via port 29 formed within the receiver tube 64. A threaded headspace ring 66 is used to adjust the position of an ammunition cartridge case between the bolt and firing pin subassembly 50 and the barrel 30 to optimize firing operation. The headspace ring 66 is retained within the receiver tube 64 by means of retaining screws 84 and screw pads 86. A bolt stop 94 and bolt stop retaining pin 96 is used to retain the bolt and firing pin subassembly 50 within the receiver tube 64. The barrel 30 is removably attached to the receiver tube 64 via a threaded connection, which allows the receiver subassembly 22, bolt and firing pin subassembly 50, and firing solenoid 15 to be removed from the launching tube 3 envelope for easier shipping as well as safety. A barrel lock slide 68 is used to prevent inadvertent rotation and possible disengagement between the barrel 30 and the receiver tube 64. A barrel lock slide lanyard subassembly 72 retained to the barrel lock slide 68 via a lanyard retaining screw 74, retains the removable barrel lock slide knob 82 to the barrel lock slide 68. A barrel lock slide detent 78, which mates with a receiving orifice 79 in the body of the receiver tube 64, assists in the alignment of the barrel lock slide 68 within the receiver tube 64. A barrel lock slide retaining pin 76 retains the barrel lock slide within the receiver tube 64.

Figure 7:
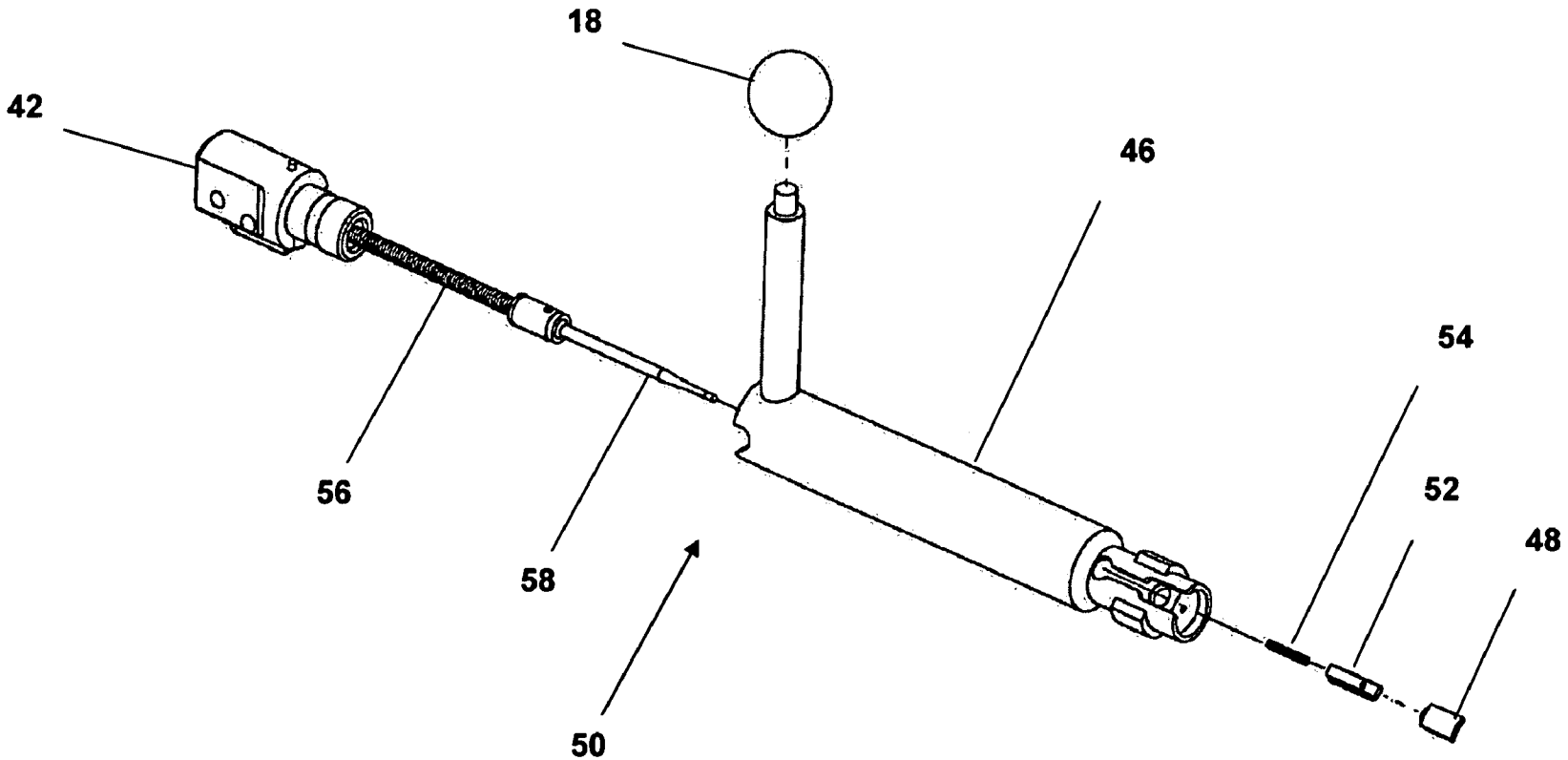
FIG. 7 is a frontal isometric exploded projection of an exemplary embodiment of the bolt and firing pin striker subassemblies.

Referring now to FIG. 7, the bolt and firing pin subassembly 50 comprises the bolt 46, bolt knob 18, extractor 48, plunger 52, and extractor spring 54, firing pin 58, firing pin spring 56 and bolt sleeve 42. The bolt 46 is manually positioned within the said receiver assembly 22 by means of bolt knob 44. The extractor 48, plunger 52, and extractor spring 54, permits extraction of expended ammunition cartridge cases from the breech of barrel 30. Firing of the sub-caliber weapon is initiated by a firing pin 58 that is used to strike the primer cap of the selected ammunition by means of a firing pin spring 56 which are supported by bolt sleeve 42. The firing pin spring 56 is compressed or "cocked" by forward motion of the bolt subassembly 50 during which a round of ammunition, placed within the receiver subassembly 22 via port 29, is positioned within the breech 95 of barrel 30. A sear 88, shown in FIG. 6, is used to retain the firing pin 58 against the compressed firing pin spring 56 during bolt 46 cocking. When the sub-caliber weapon is commanded by the operator to fire, an electrical firing signal is sent from the ancillary launching platform to the firing solenoid 15 via electrical connector 4 and RTSS 12. The RTSS timer 12 incurs a selected firing delay commensurate with the TOF of the simulated weapon. Upon expiration of the selected RTSS firing delay interval, sear 88 is disengaged from the firing pin by means of the said electro-mechanical firing solenoid 15 allowing the firing pin spring 56 to drive the firing pin 58 against a selected ammunition primer cap subsequently initiating a discharge of the sub-caliber weapon.

In one preferred operational embodiment of this invention in a training scenario, the apparatus 1 would be mounted in place of a real weapons round within an ancillary launching platform that comprises, but is not limited to, a firing computer, optical target sighting system, electrical communications connectors and requisite electrical firing circuit component subassemblies. The operator would next load the sub-caliber weapon system 2 with selected ammunition, which in one preferred embodiment would be, but not limited to, the M962, 12.7 mm Saboted, Light-Armour Penetrator-Tracer (SLAP-T), the M20 Armour Piercing Incendiary Tracer (API-T), and the M860 Short-range Training Ammunition (SRTA). The ancillary launching platform would next be energized and system checks completed. The RTSS timer 12 delay interval is next programmed as determined by the weapon-to-target distance desired in a particular training scenario. Once a target is optically sighted and the system is commanded to fire, a firing signal is sent to the RTSS timer 12, which interrupts and delays the firing signal to simulate the TOF of an actual weapon. During this delay period, the operator endeavors to maintain the target within the optical cross-hairs of the optical sighting system provided by the ancillary launching platform. Upon expiration of the RTSS-induced time delay, the firing signal is allowed to fire the sub-caliber weapon subsystem 2 delivering a sub-caliber projectile to a point on the target last sighted by the operator. By subsequently examining the target impact point of the sub-caliber projectile, the operator can immediately determine his/her ability to accurately target the weapon and gain a meaningful training experience without incurring the expenditure of relatively more expensive actual weapons rounds. In the preferred embodiment, apparatus 1 comprises components whose weights sum approximately to that of the original weapon to provide realistic handling characteristics experienced by the operator trainee.

While certain embodiments of the present invention are described in detail above, the scope of the invention is not to be considered limited by such disclosure, and modifications are possible without departing from the spirit of the invention as evidenced by the following claims:

What is claimed is:

1. A weapons training apparatus comprising:

a sub-caliber weapon adapted to be fired;

an external launching tube, said external launching tube supporting said sub-caliber weapon such that said sub-caliber weapon is enabled to be moved in a desired direction;

a recoil mitigation subsystem; and a firing signal delay timer, said sub-caliber weapon is in electrical communication with an external launching platform.

2. An apparatus of claim 1 wherein said sub-caliber weapon is of any caliber lesser than that of the external launching tube.

3. An apparatus of claim 1 wherein said external launching tube is an expended launching tube of a weapon being simulated.

4. An apparatus of claim 1 wherein the said external launch tube comprises an electrical connector to facilitate said electrical communications.

5. An apparatus of claim 4 wherein said electrical connector is a modified electrical connector originally embodied within said expended launching tube is an expended launching tube of a weapon being simulated.

6. An apparatus of claim 1 wherein said recoil mitigation system comprises a spring shock-absorbing device.

7. An apparatus of claim 1 wherein said recoil mitigation system comprises a hydraulic shock-absorbing device.

8. An apparatus of claim 1 wherein said recoil mitigation system comprises a pneumatic shock-absorbing device.

9. An apparatus of claim 1 wherein said sub-caliber weapon may be adjusted in traverse and elevation directions relative to said launching tube.

10. An apparatus of claim 9 wherein said traverse and elevation adjustment to said sub-caliber weapon is respectively achieved by means of threaded screws.

11. An apparatus of claim 9 wherein said traverse and elevation adjustment to said sub-caliber weapon is respectively achieved by means of an electro-mechanical servo-control actuator.

12. An apparatus of claim 1 wherein said firing signal delay timer is a mechanical timer.

13. An apparatus of claim 1 wherein said firing signal delay timer is an electrical timer.

14. An apparatus of claim 1 wherein said sub-caliber weapon is adapted to be fired by an electro-mechanical device.

15. An apparatus of claim 1 wherein said sub-caliber weapon is adapted to be fired by a pneumatic device.

16. A weapons training apparatus comprising:

a sub-caliber weapon;

an external launching tub adapted to support the sub-caliber weapon;

a recoil mitigation subsystem; and a range to target simulator selector in communication with said sub-caliber weapon, said range to target simulator selector delaying the firing of a chambered round to simulate the time of flight of a weapon being simulated.

17. The apparatus of claim 16 wherein said recoil mitigation system comprises a spring shock absorbing device.

18. The apparatus of claim 16 wherein said recoil mitigation system comprises a hydraulic shock absorbing device.

* * * * *